US011405993B2

(12) United States Patent
Sekulovski et al.

(10) Patent No.: US 11,405,993 B2
(45) Date of Patent: Aug. 2, 2022

(54) LIGHTING DEVICE WITH LIMITED LIGHT OUTPUT MODE

(71) Applicant: SIGNIFY HOLDING B.V., Eindhoven (NL)

(72) Inventors: Dragan Sekulovski, Eindhoven (NL); Berend Jan Willem Ter Weeme, Eindhoven (NL); Antonie Leonardus Johannes Kamp, San Francisco, CA (US); Dzmitry Viktorovich Aliakseyeu, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 17/289,073

(22) PCT Filed: Oct. 22, 2019

(86) PCT No.: PCT/EP2019/078680
§ 371 (c)(1),
(2) Date: Apr. 27, 2021

(87) PCT Pub. No.: WO2020/088985
PCT Pub. Date: May 7, 2020

(65) Prior Publication Data

US 2022/0015203 A1 Jan. 13, 2022

Related U.S. Application Data

(60) Provisional application No. 62/751,899, filed on Oct. 29, 2018.

(30) Foreign Application Priority Data

Dec. 10, 2018 (EP) ..... 18211397

(51) Int. Cl.
*H05B 45/20* (2020.01)
*H05B 47/17* (2020.01)

(52) U.S. Cl.
CPC ..... *H05B 45/20* (2020.01); *H05B 47/17* (2020.01)

(58) Field of Classification Search
CPC ..... H05B 45/20; H05B 47/17
See application file for complete search history.

(56) References Cited

U.S. PATENT DOCUMENTS 9,807,839 B1 10/2017 Gordin et al.
2006/0173245 A1 8/2006 Todd et al.
(Continued)

FOREIGN PATENT DOCUMENTS

WO 2015007120 A1 1/2015
WO 2016065539 A1 5/2016
WO 2017190986 A1 11/2017

*Primary Examiner* — Daniel D Chang

(57) ABSTRACT

The invention relates to a lighting device which is operable in two modes. In a first operating mode the flux of a lighting effect having a specified chromaticity is rendered based on the maximum (luminous) flux at which the chromaticity can be rendered by the lighting device. This can cause the maximum (luminous) flux across a range of colors that the lighting device can render to vary greatly. For example, a white color may be rendered at a far greater intensity than a primary color. In a second operating mode the specified chromaticity is rendered based on a predetermined maximum (luminous) flux for that specified chromaticity, or a color range that it is comprised in, or a predetermined maximum (luminous) flux for one or more color channels that are used in combination to render the light effect. This reduces the differences in maximum (luminous) flux of lighting effects rendered across the range of colors that are rendered by the lighting device.

8 Claims, 10 Drawing Sheets

(56) References Cited

U.S. PATENT DOCUMENTS

| | | | | |
|---|---|---|---|---|
| 2009/0079362 | A1* | 3/2009 | Shteynberg | H05B 45/24 315/294 |
| 2014/0055041 | A1* | 2/2014 | Ramer | H05B 47/11 315/153 |

* cited by examiner

LIGHTING DEVICE WITH LIMITED LIGHT OUTPUT MODE

CROSS-REFERENCE TO PRIOR APPLICATIONS

This application is the U.S. National Phase application under 35 U.S.C. § 371 of International Application No. PCT/EP2019/078680, filed on Oct. 22, 2019, which claims the benefit of European Patent Application No. EP18211397.7, filed on Dec. 10, 2018, and U.S. Provisional Patent Application Ser. No. 62/751,899, filed on Oct. 29, 2018. These applications are hereby incorporated by reference herein.

FIELD OF THE INVENTION

The invention relates to a lighting device, a method for controlling a lighting device and a computer program product for controlling a lighting device. In particular the invention relates to such device, method and computer program product wherein the lighting device is controlled based on a received chromaticity value and an intensity value.

BACKGROUND OF THE INVENTION

In a connected lighting system, for instance, the Philips Hue system, a plurality of lighting devices may be connected to a controller device, such as a bridge, via a wireless network. The light output of the lighting devices, which may typically include light emitting diodes (LEDs), can be controlled wirelessly via the controller device, for instance, with regards to their hue, saturation and/or brightness. To this end, a smartphone that can be connected to the controller device may execute an app in order to wirelessly control the lighting devices via the controller device.

In many cases, one type of lighting device is used for ambient lighting, e.g. providing color saturated lighting effects, and another type of lighting device is used for functional lighting, e.g. providing white lighting effects. By rendering a low intensity reddish lighting effect, the atmosphere in a room where the lighting effect is rendered may be made more romantic. By rendering a high intensity cool white lighting effect, the concentration level of user performing a task may be increased. Lighting devices that support both ambient lighting and functional lighting may face technical limitations in view of non-overlapping requirements for these two different functions.

SUMMARY OF THE INVENTION

The inventors have realized that lighting devices of which the chromaticity of the rendered lighting effect can be controlled, are often used to output both functional and ambient lighting. However, such lighting devices typically provide different maximum luminous flux. Luminous flux (or: photometric flux) is the measure of the perceived power of light. This is different from radiant flux, which is the total power of electromagnetic radiation (including infrared, ultraviolet, and visible light). Luminous flux is adjusted to reflect the varying sensitivity of the human eye to various wavelengths of light. For clarity, the explanation given below is provided referring to luminous flux, however the skilled person will understand that similar examples may be provided using radiant flux.

For example, a lighting device may be able to output 800 lumens of white light, yet only 40 lumens of blue light. Thus, when the lighting device is controlled to provide blue light at maximum intensity and then change to white light at maximum intensity, or vice versa, a user will perceive a change in light intensity. This is particularly troublesome when dynamic light effects are rendered which cycle through various colors.

It is an object of the invention to provide a lighting device, a method for controlling a lighting device and a computer program product for controlling a lighting device that overcome at least some of the problems indicated above.

In a first aspect a lighting device is provided. The lighting device comprises an input and a controller. Such a lighting device may be a lamp, a luminaire, a light fixture, a light strip or any other type of lighting device. The lighting device is for providing a lighting effect, which it may render using light emitting diodes (LEDs), organic light emitting diodes (OLEDs), nanodots or any other technology.

The input is arranged for receiving one or more control commands. The input may be a wired or wireless input, such as, for example, an interface to a wireless network such as a Zigbee, Bluetooth or WiFi network. The one or more control commands specify a chromaticity value and an intensity value relative to an intensity value range. The chromaticity value can, for example, be an x, y value or an RGB value (which provides both chromaticity and intensity) or any other value indicative of a chromaticity of light to be rendered. The chromaticity value may be specified relative to a color space, such as CIELAB, RGB, sRGB, etc.

The controller is arranged for controlling the lighting device to render a lighting effect based on the chromaticity value and the intensity value. The lighting effect rendered may be the exact chromaticity value specified or an approximation of the chromaticity value specified. The controller is further arranged to switch, based on a switch command received via the input, between a first and a second operating mode.

In the first operating mode, the flux at which the lighting effect is rendered is determined based on: the specified chromaticity, the specified intensity value and a maximum flux at which the lighting effect can be rendered by the lighting device. In the second operating mode, the flux at which the lighting effect is rendered is determined based on: the specified chromaticity, the specified intensity value and a predetermined maximum flux. This predetermined maximum (luminous) flux is lower than the maximum (luminous) flux at which the lighting effect can be rendered by the lighting device.

A lighting device according to the first aspect may thus be controlled to operate in one of two modes. In the first operating mode, the lighting device may be controlled to output maximum (luminous) flux for each chromaticity according to which it is controlled. For example, the maximum (luminous) flux for a specified purple color may be 180 lumens and for a specified white color it may be 800 lumens. When the lighting device changes its output from said purple color to said white color, while being controlled to render the light effect at maximum (luminous) flux, the flux increases dramatically. This is very visible to a person present nearby the lighting device.

The (luminous) flux range over the various colors which the lighting device can render is thus larger in the first than in the second mode. In other words, in the second mode the variation of maximum (luminous) flux of chromaticity that the lighting device can render is smaller than in the first mode. This may provide for smaller changes between the (luminous) flux of light effects rendered according to the same intensity level (as mapped to the maximum flux) of different colors. Thus, when a dynamic light effect is provided comprising various different colors, when two light effects of different chromaticity are to be rendered according to the same light intensity level, the (luminous) flux for these rendered light effects will be more similar in the second mode.

In an embodiment of the lighting device according to the first aspect, the predetermined maximum (luminous) flux is defined for the specified chromaticity. Further, the intensity value range is mapped to the light effect flux for the specified chromaticity based on the predetermined maximum (luminous) flux. This is advantageous as for a single color, multiple colors or one or more color ranges the predetermined maximum (luminous) flux may be set. For example, for a range of white colors that the lighting device can render at 300-400 lumens (depending on which white color it is), the predetermined maximum (luminous) flux may be set to 200 lumens. In the earlier example where the maximum (luminous) flux of blue (e.g. only the blue LED on, at its maximum, in an RGB based lighting device) is 40 lumens, and purple may be 180 lumens (both red and blue LED on in an RGB based lighting device), and white can be rendered at 400 lumens this limits the white light output to 200 lumens thereby making the maximum intensity of the light output more consistent: from a range of 40-400 lumens it will now be within a 40-200 lumens range. Advantageously, the maximum (luminous) flux for all chromaticity can be set to the same value.

As per the example provided, the lighting device may be arranged to render the light effect by mixing light output of multiple color channels. Such as an RGB lighting device which has a color channel for each of the three primary colors: red, green and blue. However, the benefits provided also extent to lighting devices that use other manners of rendering various colors. When the lighting device has different lumen output for different colors in the first mode, the second mode proves beneficial as explained above.

Continuing the embodiment, the predetermined maximum (luminous) flux may be defined for at least one of the multiple color channels. Further, the flux of the at least one of the multiple color channels may be limited to the predetermined maximum (luminous) flux. In other words, in e.g. an RGBW lighting device a maximum (luminous) flux may be set for each channel. For example, if the red, green and blue channels can together render 400 lumen and the white channel is capable of rendering 500 lumen, the white channel may be set to a predetermined maximum of e.g. 0 or 300 lumens in the second mode. This allows the lighting device to render bright light in the first mode, when it can render 500 lumens using the white channel and further approx. 400 lumens by combining the output of the red, green and blue channels for a total of 900 lumens when all channels are controlled the their maximum output. In the second mode however, the total is not 900 lumens, but instead 400 lumens (when the white channel's maximum predetermined flux is set to 0) or 700 lumens (when the white channel's maximum predetermined flux is set to 300). Setting the white channel's maximum (luminous) flux to 0 lumens, may be performed by simply turning the white channel off in the second mode.

As yet a further example, instead of limiting the output of the white channel, the output of the red, green and blue channels may be limited when rendering a white color. The output of the white channel may then not be limited. Continuing the example above, the white channel may render 500 lumens and each of the red, green and blue channels may be set to a predetermined maximum (or any other value, including 0, be it the same for each channel or not). This is beneficial as better quality white light can be rendered, compared to using predominantly the non-white color channels to render white light. Further, this may provide for more (energy) efficient rendering or white light by the lighting device.

As another example, assuming the maximum (luminous) flux of the blue channel is 40 lumens, each of the other channels may simply be set to a predetermined maximum (luminous) flux equal to the maximum (luminous) flux of the blue channel or to any other value (e.g. based on typical output of a TV). Thus, the predetermined maximum (luminous) flux may be determined based on maximum (luminous) flux of one of the multiple channels, such as the one of the multiple channels having the lowest maximum (luminous) flux. Alternatively, the predetermined maximum (luminous) flux may be determined based on combined maximum (luminous) flux of a plurality of the multiple channels, such as the primary color channels.

Although in the examples provided here the maximum (luminous) flux of a channel is provided as a particular lumen output, in some lighting devices the maximum (luminous) flux of one or more channels and thus of the lighting device as a whole, may be dependent upon various external factors. For example, the maximum (luminous) flux may be limited based on operating conditions of the lighting device. If (part of) the lighting device becomes too warm or too cold, the maximum light output of one or more channels may be limited. The same can occur when a driver of the one or more channels is required to provide current beyond a threshold or if the driver has been turned on for an extended period of time.

In an embodiment according to the first aspect, the switch command is comprised in the one or more control commands. For example, the switch and control command(s) may be a single Zigbee message.

In yet a further embodiment according to the first aspect, the intensity value range comprises one exceptional value or a range of exceptional values which causes the controller to, when in the second operating mode, to render the light effect to ignore the predetermined maximum (luminous) flux and instead render the specified chromaticity above the predetermined maximum (luminous) flux of the lighting device for the specified chromaticity. For example, if the light effect to be rendered is provided as an RGB(W) value wherein each channel comprises 8 bits (values 0-255), then the range 0-254 may be mapped from no light output to the predetermined maximum (luminous) flux (e.g. 100 lumens) of the channel concerned, whereas the value 255 is mapped to the maximum (luminous) flux of e.g. 180 lumens for the channel concerned.

As another example, a first range of the RGB(W) values, e.g. values 0-200, is mapped from no light output to the predetermined maximum (luminous) flux (e.g. 100 lumens) of the channel concerned, whereas a second range of the RGB(W) values, e.g. values 200-255, are mapped from the predetermined maximum (luminous) flux (e.g. 100 lumens) to the maximum (luminous) flux (e.g. 180 lumens) of the channel concerned.

Although the examples provided here discuss RGB and RGBW lighting devices, the skilled person will understand that the same teachings may be applied to other lighting devices, such as, but not limited to: RGBWW (e.g. with a cold white and warm white; also known as RGB-CW-WW) or RGBAW (with amber) or RLCWW (with lime and cyan) or RGBCY (with cyan and yellow).

According to a second aspect, a method for controlling a lighting device is provided. The method comprises: receiving one or more control commands, via an input, the one or more control commands specifying a chromaticity value and an intensity value relative to an intensity value range; and controlling the lighting device, via a controller, to render a lighting effect based on the chromaticity value and the intensity value; wherein, based on a switch command received via the input, the controlling of the lighting device is performed (i) in a first operating mode, in which the flux at which the lighting effect is rendered is determined based on: the specified chromaticity, the specified intensity value and a maximum flux at which the lighting effect can be rendered by the lighting device; or (ii) a second operating mode, in which in which the flux at which the lighting effect is rendered is determined based on: the specified chromaticity, the specified intensity value and a predetermined maximum flux.

According to a third aspect, a computer program or suite of computer programs is provided, comprising at least one software code portion or a computer program product storing at least one software code portion, the software code portion, when run on a computer system, being configured for enabling the method according to the second aspect to be performed.

It shall be understood that aspects described above have similar and/or identical preferred embodiments, in particular, as defined in the dependent claims. It shall be understood that a preferred embodiment of the present invention can also be any combination of the dependent claims or above embodiments with the respective independent claim.

These and other aspects of the invention will be apparent from and elucidated with reference to the embodiments described hereinafter.

DETAILED DESCRIPTION OF EMBODIMENTS

Figure 1:
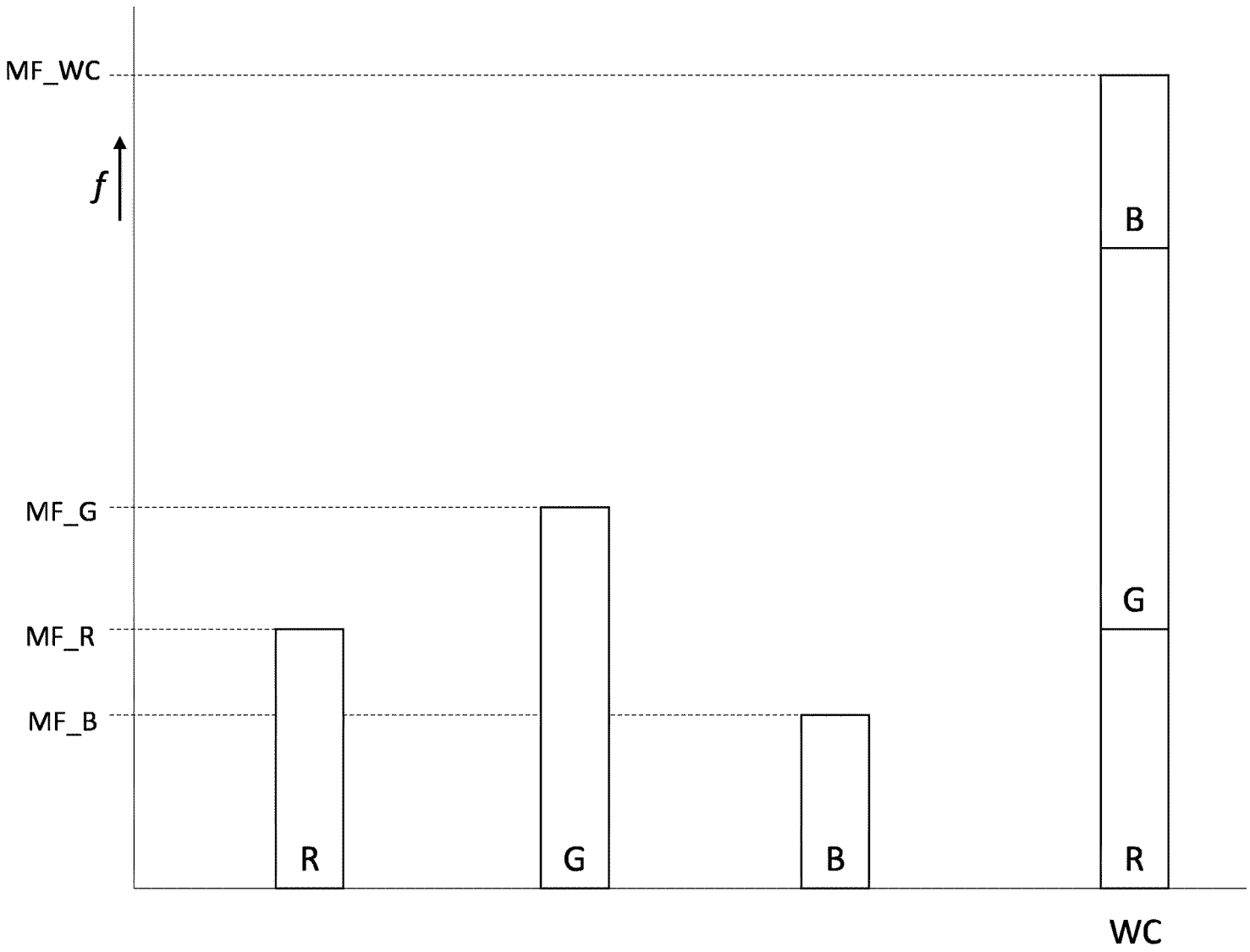
FIG. 1 shows schematically and exemplarily a diagram indicating maximum (luminous) flux of primary color channels and of white light rendered using these primary color channels.

FIGS. 1-5 illustrate how a lighting device can have different maximum (luminous) flux at different chromaticity and which issues this may cause. In FIG. 1 a red (R), green (G) and blue (B) channel of a lighting device are shown, this is generally known as an RGB lighting device. Each of the three channels (R, G, B) has a different maximum (luminous) flux compared to the other three channels, in this example. The maximum (luminous) flux of the blue channel (B) is MF_B and is the lowest, followed by the maximum (luminous) flux of the red channel (R) which is MF_R and finally the maximum (luminous) flux of the green channel (G) is MF_G which is the highest of these three channels. As shown in the diagram, a white color (WC) can be generated by combining the output of the three primary color channels red (R), green (G) and blue (B). The maximum (luminous) flux for the white color (MF_WC) is thus determined by the maximum (luminous) flux of the red channel (MF_R), the maximum (luminous) flux of the green channel (MF_G) and the maximum (luminous) flux of the blue channel (MF_B). Obviously, the white color rendered in this example would be more reddish (given the amount of red in the light output when each of the RGB channels is controlled to its maximum (luminous) flux). The diagram indicates that, in this exemplary embodiment, each of the individual channels (R, G, B) have different maximum (luminous) flux (MF_R, MF_G, MF_B) and that the maximum (luminous) flux of the white color (MF_WC) is far greater than that the maximum (luminous) flux of any of the individual channels.

Although explained here on the basis of the lighting device having three primary color channels (R, G, B), the same holds for any lighting device that has different maximum (luminous) flux depending on the chromaticity of the light effect rendered. In case each of the three channels of an RGB lighting device provides the same maximum (luminous) flux, any color that combines the light output of multiple channels would still have a higher maximum (luminous) flux. For example, when white light is rendered this is rendered by combing red, green and blue light.

As explained before, although the examples provided here discuss RGB and RGBW lighting devices, the skilled person will understand that the same teachings may be applied to other lighting devices, such as, but not limited to: RGBWW, RGBAW, RLCWW or RGBCY.

The luminous intensity rendered by a lighting device when rendering white using three primary color channels (R, G, B) need not be the exact total of the amount of lumens each individual channel (R, G, B) can render. For example, due to constraints of the driver or due to thermal constraints, the maximum (luminous) flux for white light may be lower than the combined flux of the red, green and blue channels. The three primary channels may for example be controlled at e.g. 90% of their output when all three are fully on. In fact, the maximum luminous flux may change over time, for example due to the temperature of the lighting device changing.

Figure 2:
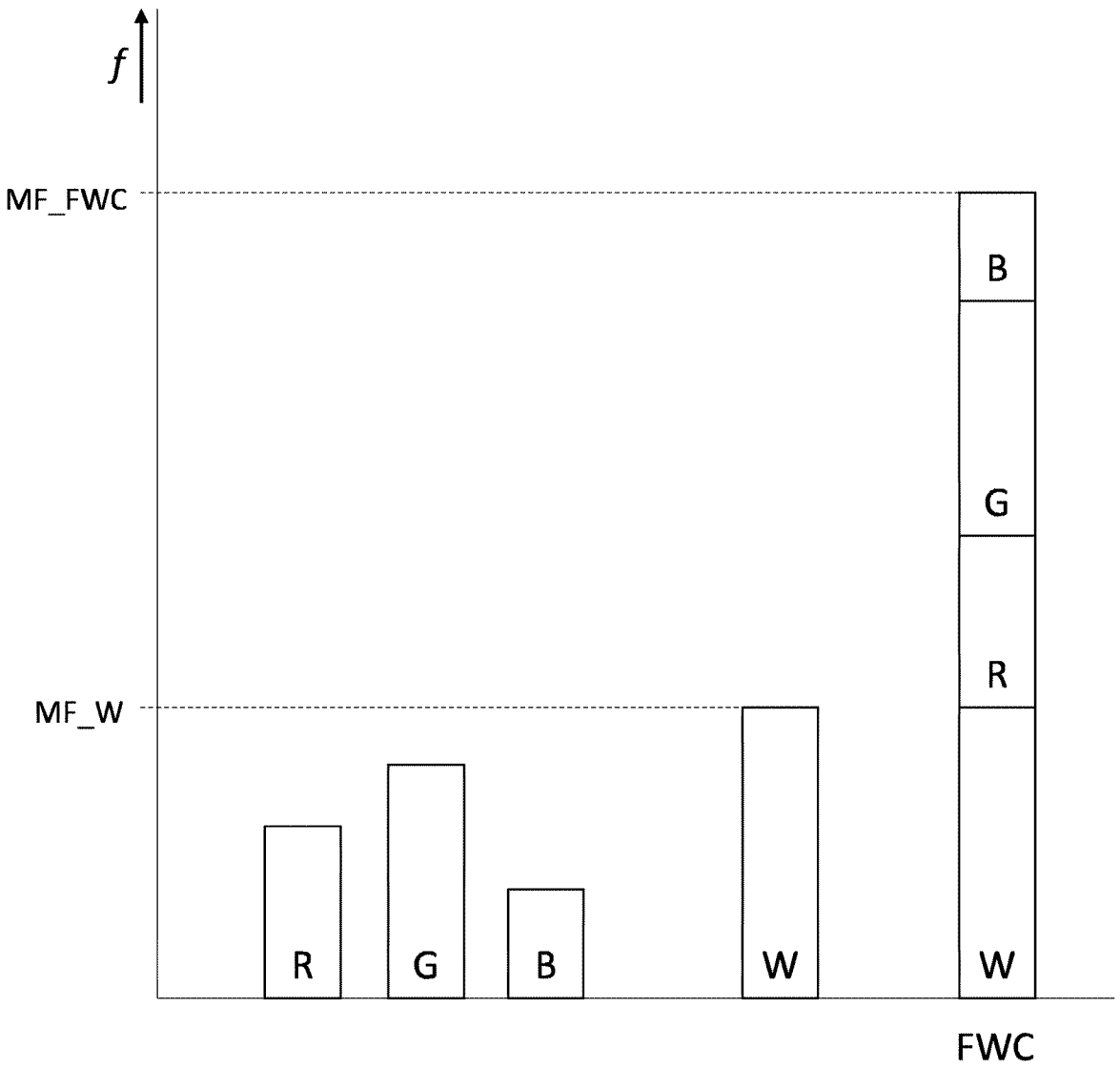
FIG. 2 shows schematically and exemplarily a diagram indicating maximum (luminous) flux of primary color channels and a white channel, and of white light rendered using these primary color channels and the white channel.

In FIG. 2, the same underlying principles as in FIG. 1 are shown, however an additional white channel (W) is added. This is generally known as an RGBW lighting device. The white channel (W) has a maximum (luminous) flux (MF_W). An RGBW lighting device may render a white color using only the white channel (W) or may add in some light output of the primary color channels (R, G, B) to change the chromaticity, e.g. from a cool white (e.g. more blueish) to a warm white (e.g. more reddish). Further, such a lighting device may use only the three primary color channels (R, G, B) to render a white hue. In fact, for maximum lumens output an RGBW device may control all channels to their maximum (luminous) flux to render, what is indicated in the diagram, a full white color (FWC) which comprises the lighting output of each of the red, green, blue and white channel (R, G, B, W) and has a higher maximum (luminous) flux (MF_FWC) than the maximum (luminous) flux of the white channel (MF_W) only. Obviously, the chromaticity of the white rendered by the combination of the primary color channels (R, G, B) and the chromaticity of the white channel (W) may, but need not, be (slightly) different. As such, the chromaticity of the light rendered by the white channel (W) compared to rendering a full white color by using, in this example, all channels (R, G, B, W) may also be (slightly) different. In other words, although indicated in this example as a full white color, the color rendered by controlling all channels to their maximum output may be white or any other color.

Figure 3:
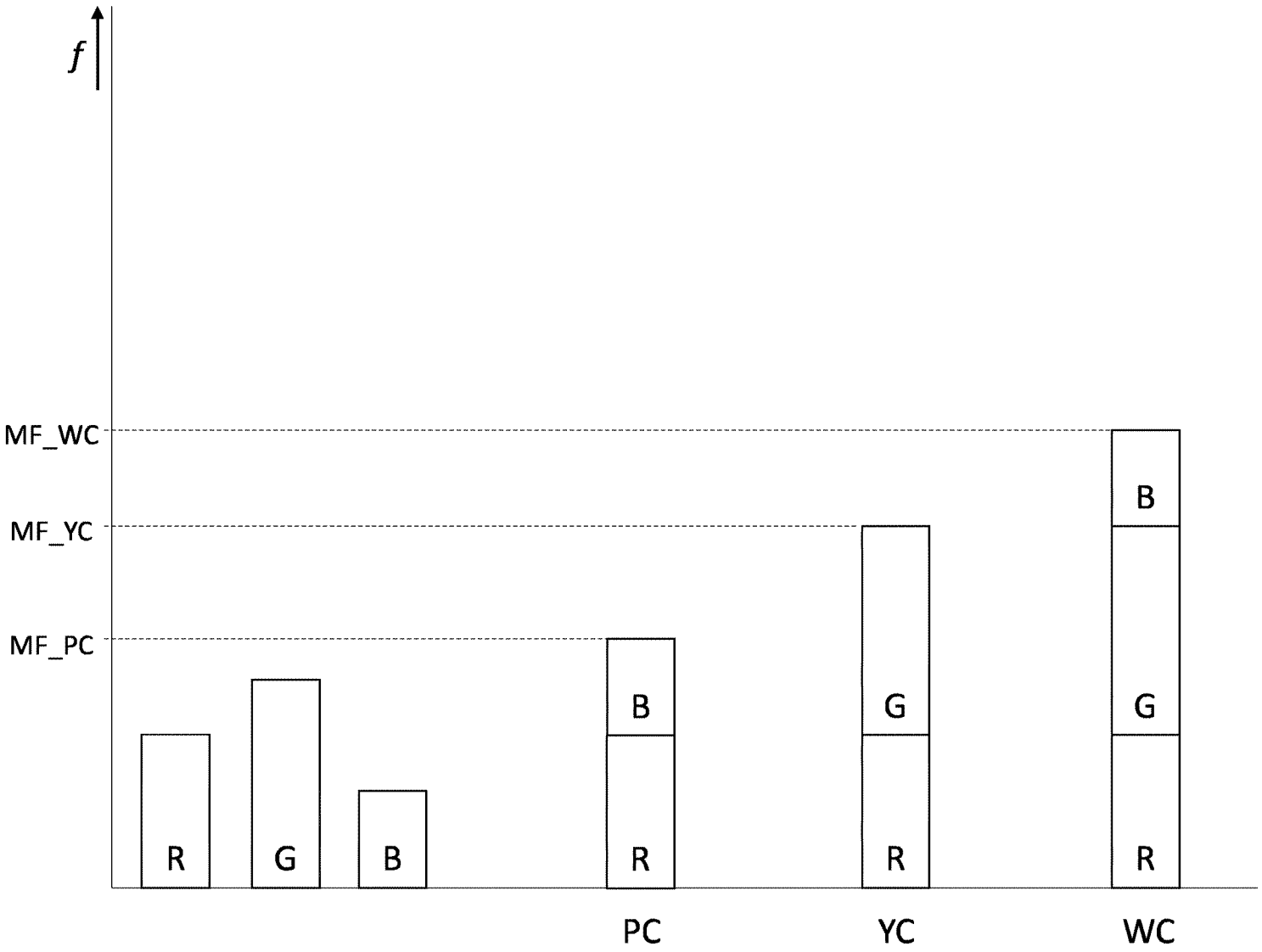
FIG. 3 shows schematically and exemplarily a diagram indicating maximum (luminous) flux of various colors.

In FIG. 3 it is shown how a purple color (PC), yellow color (YC) and a white color (WC) are rendered. The purple color (PC) is rendered using the red (R) and blue (B) channel. The yellow color (YC) is rendered using the red (R) and green (G) channel. The white color (WC) is rendered using the red (R), green (G) and blue (B) channel. The maximum (luminous) flux for purple (MF_PC) is lower than the maximum (luminous) flux for yellow (MF_YC) and both are lower than the maximum (luminous) flux for white (MF_WC).

Figure 4:
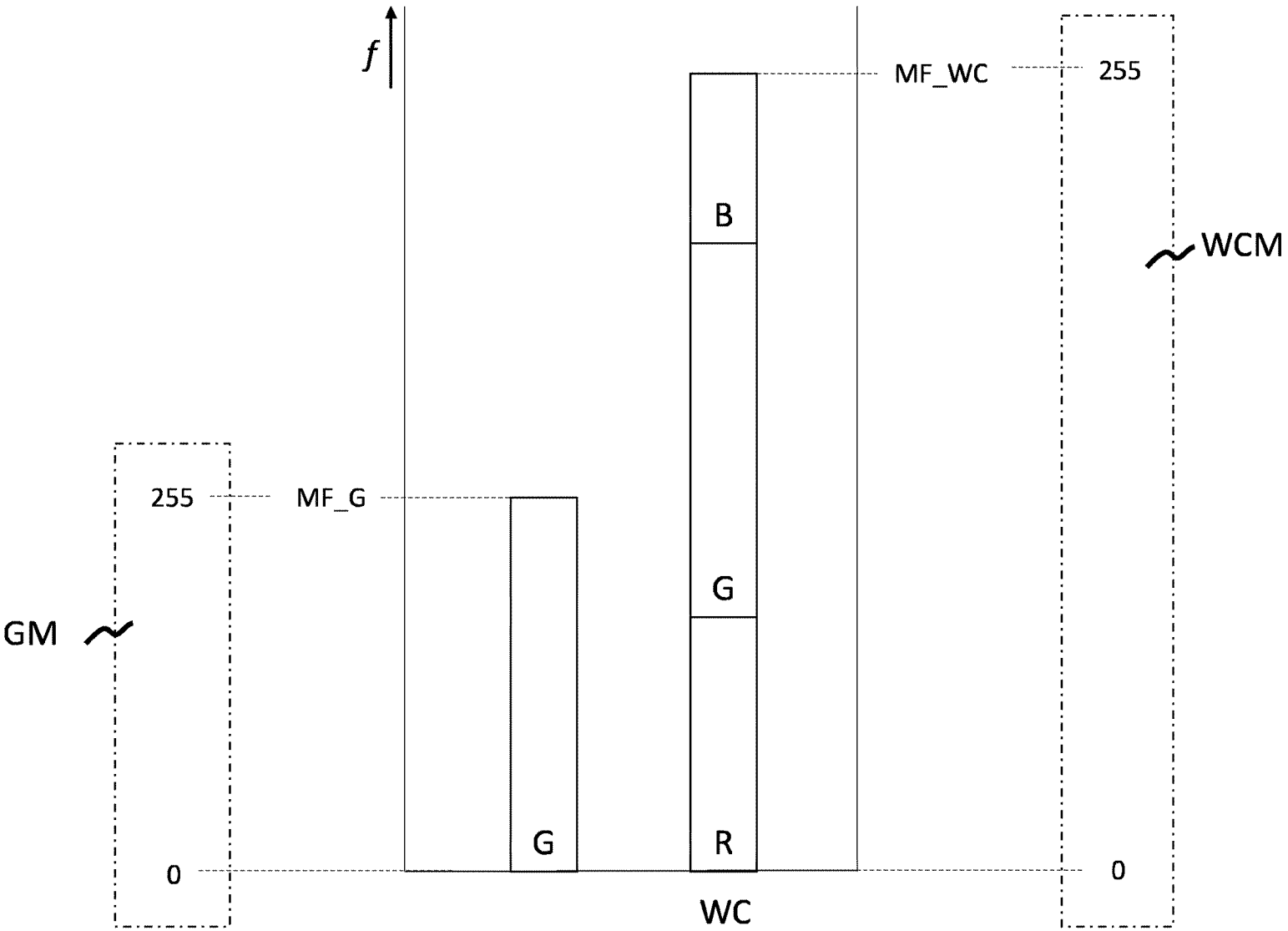
FIG. 4 shows schematically and exemplarily a diagram indicating mapping of an intensity value range to maximum (luminous) flux of various colors.

FIG. 4 shows how an intensity value range is mapped to the flux of a light output of a certain chromaticity. The mapping for the green channel (GM) ranges, in this example, from 0-255. In other words, this is an eight bit intensity map, which has 256 values. The green mapping (GM) ranges from no light output, which is mapped to intensity value=0, to light output at the green channel's maximum (luminous) flux (MF_G), which is mapped to intensity value=255. The mapping of the intensity values in between, 1-254, may be mapped linearly to the flux of the green channel. However, other mappings may be used which allocated more intensity values to specific parts of the (luminous) flux range for a specific channel or color. For example, the minimum flux of a channel greater than zero (i.e. off) may be more than 1/255 of the maximum (luminous) flux of the channel. As such, an intensity value=1 can be mapped to a flux which is greater than half of the flux of an intensity value=2. In fact, the intensity value=0 can be mapped to a light output other than no light output.

For a white color (WC) which is rendered using all three primary color values (R, G, B) the intensity value range is mapped in a similar fashion. The mapping for the white color (WCM) shown has the greatest value in the intensity value range, in this example 255, mapped to the maximum (luminous) flux of the white color (WC) and the lowest value in the intensity value range, in this example 0, mapped to no light output. This demonstrates that the mapping of the intensity value range may be relative to the maximum (luminous) flux of a channel, such as the green channel (G), or relative to the maximum (luminous) flux of a color, such as the white color (WC). The same can be said of other channels (R, B, W) or other colors (PC, YC, FWC), as provided in these examples or otherwise.

The maximum (luminous) flux of a channel or color need not be the absolute maximum light output that the channel or the lighting device rendering the color can provide. For example, a red channel (R) in a lighting device can be provided by a Light Emitting Diode (LED) which emits a red color of light. This LED may be capable of emitting 200 lumens of red light at peak current, however, to ensure a sufficiently long operational lifetime, it may be provided in the lighting device with a current that limits its maximum (luminous) flux to 150 lumens. As another example, the LED may be controlled using Pulse Width Modulation (PWM) and the driver generating the PWM signal may not be capable of driving the LED emitting the red light to a maximum (luminous) flux beyond 150 lumens. The maximum (luminous) flux may even be dependent upon environmental conditions. For example, it may be lower when an LED is at the end of its lifetime, when the driver and/or LED temperature are above or below a certain threshold, etc. Thus, the maximum (luminous) flux can be (far) less than what is (theoretically) possible to render for a channel or color.

As yet another example, the intensity value range may be mapped to flux values that a lighting device cannot achieve which would cause a subrange (e.g. intensity values 220-255) of the intensity value range to be mapped to the maximum (luminous) flux.

Figure 5:
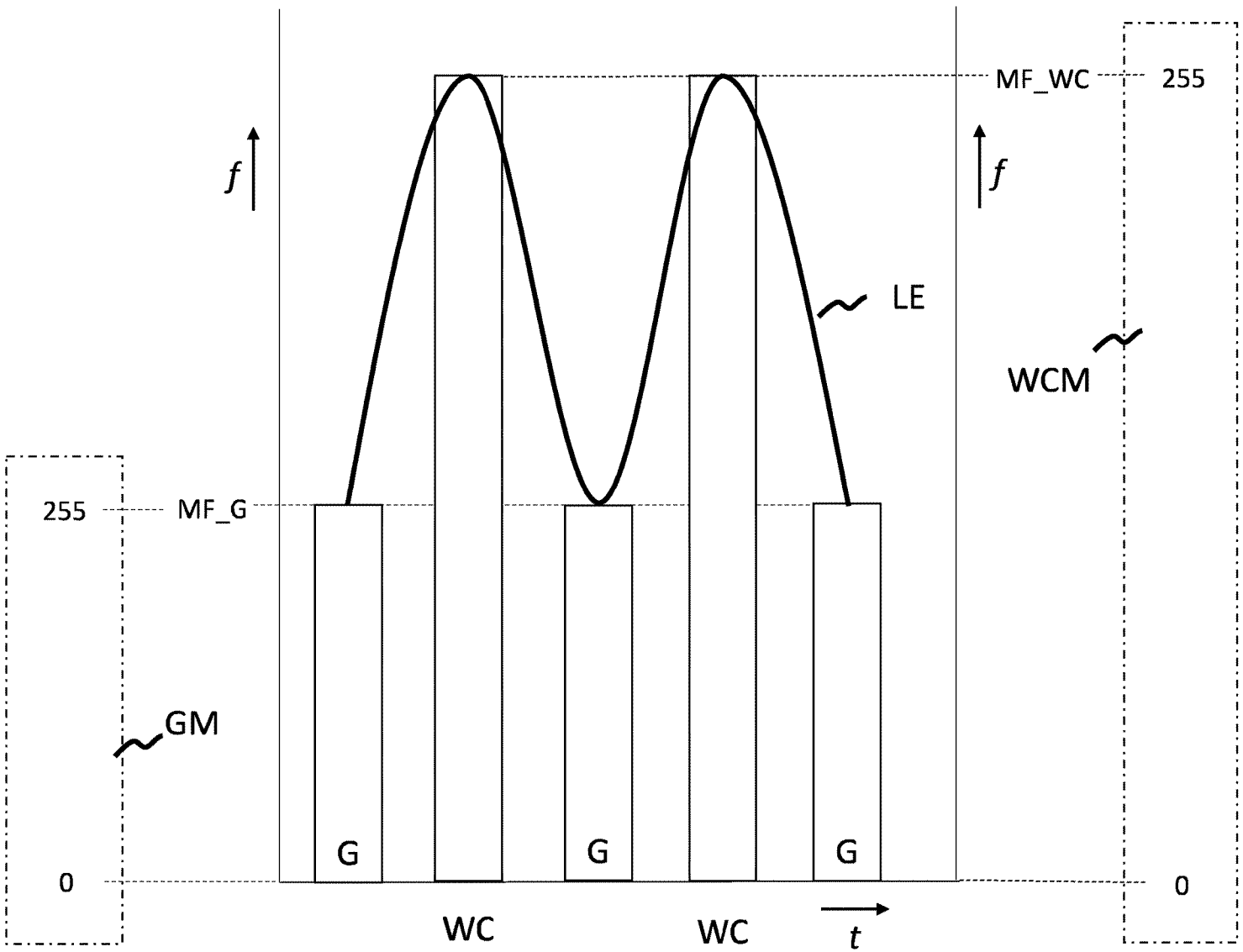
FIG. 5 shows schematically and exemplarily a diagram indicating flux variation of a lighting device outputting a dynamic lighting effect cycling through colors of light that have different maximum (luminous) flux.

In FIG. 5 a flux-time diagram is shown which illustrates how a light effect (LE) changes intensity over time as a sequence of colors is rendered. First the green channel (G) is controlled to output at maximum (luminous) flux (MF_G) and then a white color (WC) is rendered at maximum (luminous) flux (MF_WC). This sequence then continues, as shown in the diagram. Although each light effect is rendered at the maximum value in the intensity value range, in this example value 255, the flux of the light effect rendered is different between the color green being rendered using the green channel (G) and the color white (WC) being rendered (e.g. using three primary colors). Thus, when a command such as "color=green, intensity value=255" followed by a command "color=white, intensity value=255" is sent, the flux of the lighting device changes as the chromaticity of the light rendered changes while the intensity value remains the same (255 in this example).

A user may expect, when a dynamic lighting effect is rendered which comprises multiple different colors in sequence, that when different colors of light are rendered each at maximum intensity are substantially equal in flux. However, as shown here this may not be the case. Although this example uses the maximum (luminous) flux and the intensity value=255, the same holds for other values. When the intensity value range is mapped linearly to the flux, each intensity value above 0 (assuming intensity value=0 is mapped to zero (luminous) flux; i.e. off), for the green channel (G) will have different flux compared to the same intensity value for the white color (WC) rendered by the lighting device in this example. Thus, when the lighting device is controlled to render the color green at half of maximum (luminous) flux for that chromaticity and then to render the color white at half of the maximum (luminous) flux for that chromaticity, there will also be a change in the (luminous) flux of the dynamic light effect so rendered.

Figure 6:
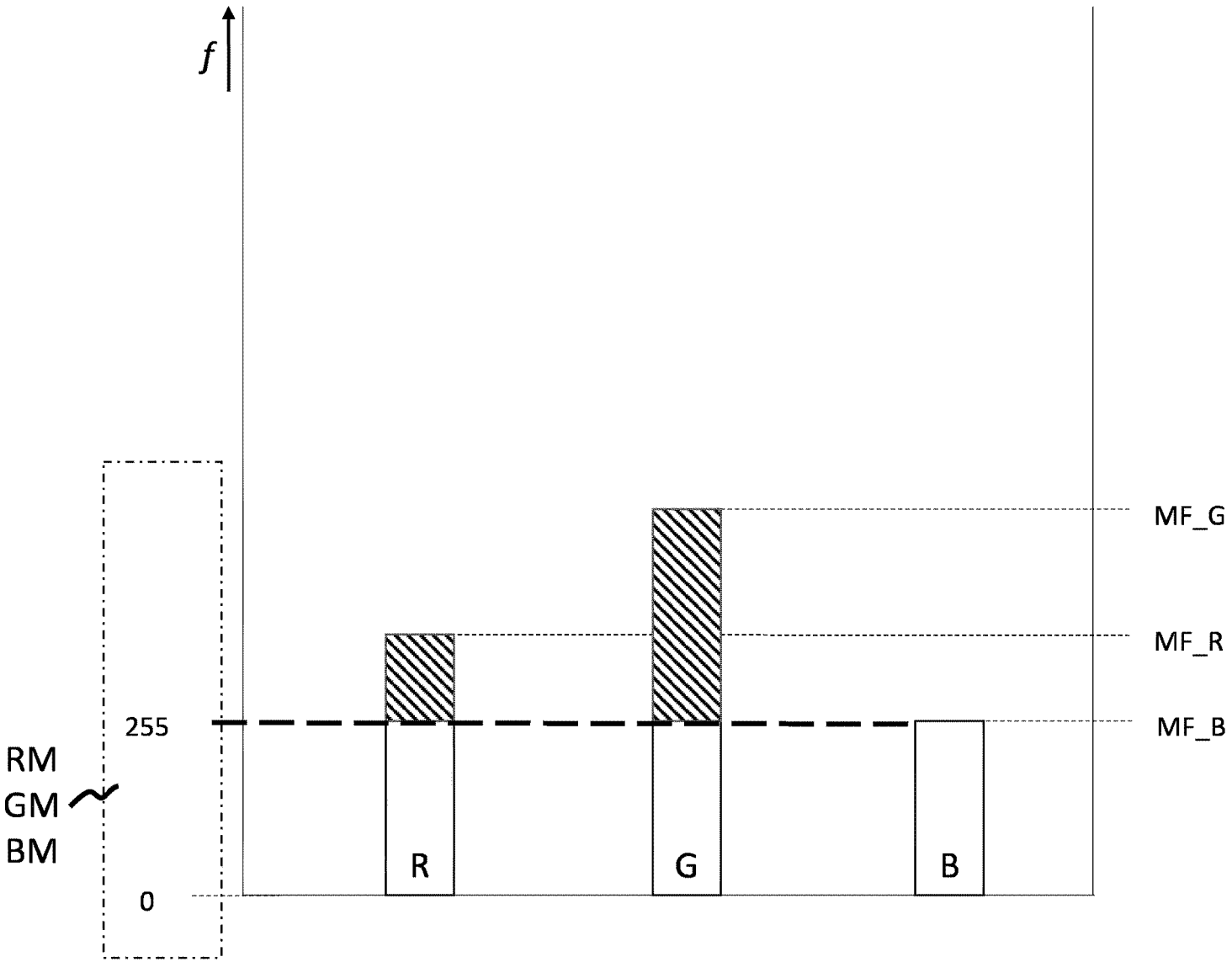
FIG. 6 shows schematically and exemplarily a diagram indicating mapping of an intensity value range to flux of primary channels.

In FIG. 6 the principle is demonstrated that the mapping of the intensity value range is performed not up until maximum (luminous) flux of each individual channel (or color), but instead to a predetermined maximum (luminous) flux. This is one example of how the lighting device may operate in the second operational mode. In this example, the maximum (luminous) flux of the blue channel (MF_B), e.g. 40 lumens, is taken as the predetermined maximum. The output of the red channel (R) and the green channel (G) are then capped to this predetermined maximum (luminous) flux of 40 lumens. Thus, each of the intensity value mappings are channel based and the red channel mapping (RM), green channel mapping (GM) and blue channel mapping (BM) ranges from 0-40 lumens over intensity values 0-255

In this example, the flux of the various colors that may be rendered by the lighting device are normalized to an extent. In this example, the red channel (R) has a maximum (luminous) flux (MF_R) of 100 lumens, the green channel (G) has a maximum (luminous) flux (MF_G) of 200 lumens and the blue channel (B) has a maximum (luminous) flux (MF_B) of 40 lumens. To render a specific color, all three primary color channels (R, G, B) may be controlled to output their maximum (luminous) flux. Thus, a specific chromaticity can be rendered by the lighting device at 340 lumens (100 lumens of red, 200 lumens of green and 40 lumens of blue). By applying the predetermined maximum (luminous) flux to each of the primary color channels, instead a specific chromaticity of white is rendered at 120 lumens (40 lumens for each of the three primary color channels). In other words, the maximum (luminous) flux of the light effects that the lighting device can render is changed from 40-340 lumens to 40-120 lumens.

Figure 7:
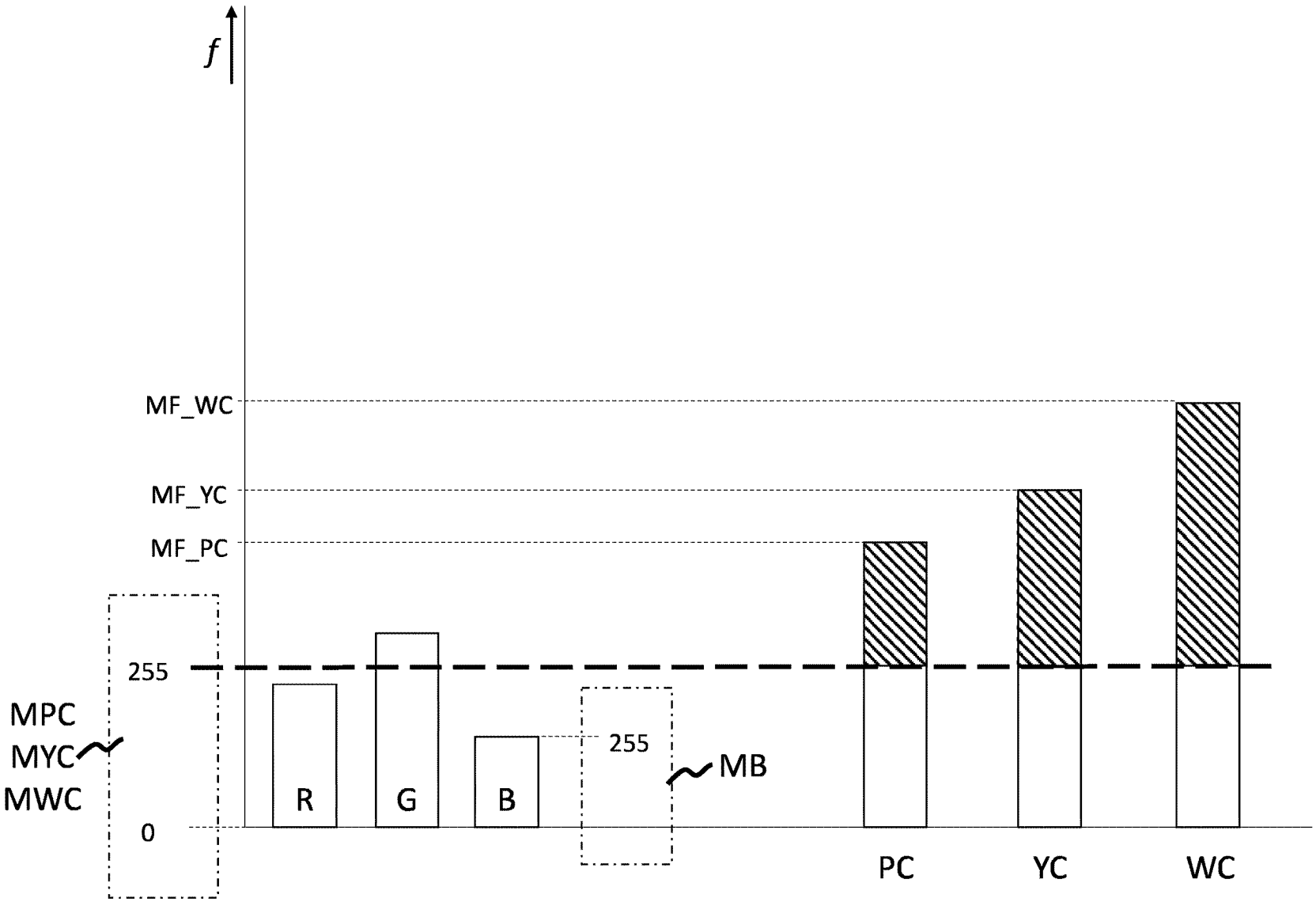
FIG. 7 shows schematically and exemplarily a diagram indicating mapping of an intensity value range to flux of various colors.

The same principle may be applied, as illustrated in FIG. 7, to limit the output for each chromaticity of lighting effect that the lighting device may render. The predetermined maximum (luminous) flux is now set at 100 lumens for each chromaticity. Shown are the colors purple (PC), yellow (YC) and white (WC) which are rendered using the three primary colors (R, G, B). For each of these the intensity values, 0-255 in this example, are mapped to the predetermined maximum (luminous) flux. Thus, to create a specific color purple the red channel may provide 60 lumens and the blue channel may provide 40 lumens to make a shade of purple at 100 lumens. This does not imply that light of each chromaticity can be rendered at 100 lumens. Shown in this example is that the color blue as rendered by only the blue channel (B) uses a different mapping, as it can, continuing the example, be rendered at the blue channels maximum (luminous) flux of 40 lumens. Not illustrated in the same level of detail for legibility, the red channel, continuing the example, can render no more than 200 lumens, thus also falling short of the maximum (luminous) flux of other colors. It is clear that the flux range across the colors that the lighting device can render has been made narrower.

These examples are not intended to limit the scope of the claimed subject matter and are only intended to illustrate certain principles. The predetermined maximum (luminous) flux may be applied to all colors of light and be selected to match the maximum (luminous) flux of the channel which has the lowest maximum (luminous) flux of all channels. In other words, the predetermined maximum (luminous) flux may be set such that for a light effect of each chromaticity that the lighting device can render, the flux at the largest intensity value (e.g. 255 in the example) is the same. For example, the maximum (luminous) flux may be set at 40 lumens for each chromaticity of lighting effect the lighting device may render. In this example, that is the maximum (luminous) flux of the blue channel and thus pure blue can be rendered at 40 lumens and all other colors, although the lighting device could technically render them at higher flux, can also be rendered only at 40 lumens as this is the predetermined maximum (luminous) flux.

As explained above, the predetermined maximum (luminous) flux can be determined for various colors or can be set per channel. It can be beneficial to simply limit the maximum (luminous) flux of each channel, as this is relatively easy to do. Although this limits the flux range of the lighting device across the colors it can render, there may still be a wider range than preferred. It can be beneficial to limit to determine a maximum (luminous) flux for each chromaticity of light effect, to further limit this range. This may require more advanced hardware, software or a combination of both.

Figure 8:
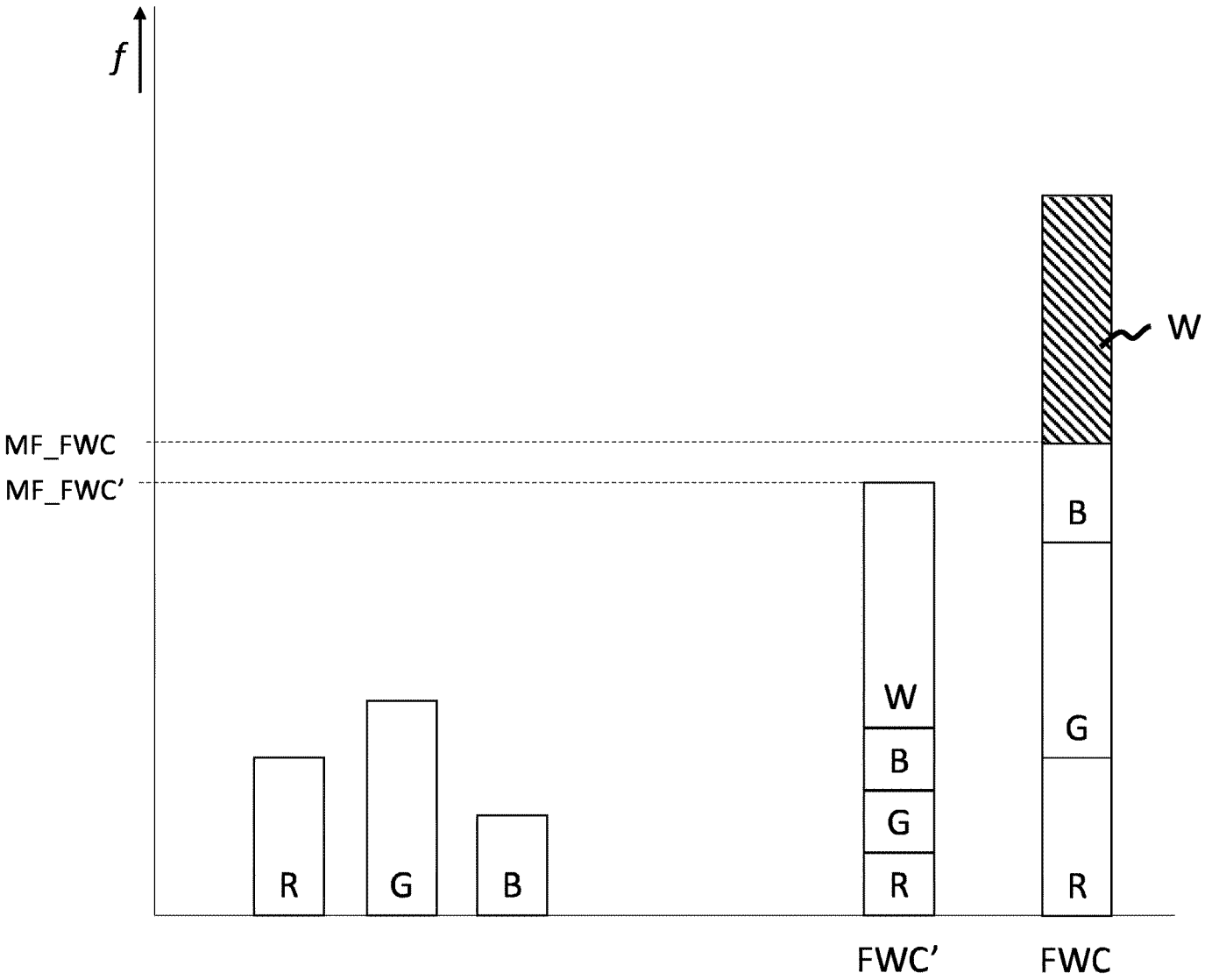
FIG. 8 shows schematically and exemplarily a diagram indicating shutting down a white channel in a RGBW lighting device.

In FIG. 8 another option is shown to reduce the (luminous) flux range of the lighting device across the range of chromaticity of the lighting effects it can render.

As a first example, a version of a full white color (FWC') may be rendered using all of the red, green, blue and white channels; however using a predetermined maximum flux for the red, green and blue channels (or: the non-white channels). This limits the maximum (luminous) flux (MF_FWC') the lighting device renders for this version of a full white color, yet makes full use of the white channel to provide e.g. a higher quality of white light and/or more (energy) efficient rendering of white light.

As a second example, an RGBW lighting device, although it has a white channel (W) that may be used, will only render lighting effects using the primary color channels (R, G, B). Thus, when the color white (WC) is rendered, the white channel is not used (as indicated in FIG. 8 by the crossing out) and the maximum (luminous) flux (MF_FWC) for the full white color (FWC) is lower compared to when the white channel would be used. The same applies for any other color in which the white channel would be used (e.g. various white hues).

In these examples, the lighting device has a white channel. The same principles would apply for a lighting device having other channels next to primary color channels, such as lime, multiple whites, etc. In fact, a lighting device having two white channels, warm white and cold white, would also benefit from the principles explained above. Assume that a warm white channel can output 800 lumens and a cold white channel can output 800 lumens. When cold white is rendered using only the cold white channel, it will be rendered at 800 lumens. When warm white is rendered using only the warm white channel, it will be rendered at 800 lumens as well. Any chromaticity between warm and cold white will be rendered using both the warm and cold white channels and one chromaticity may thus be rendered by controlling both the warm and cold white channel to each provide 800 lumens, for a total of 1600 lumens. By applying a predetermined maximum (luminous) flux of 800 lumens, each chromaticity of light effect to be rendered will have the same maximum (luminous) flux.

Figure 9:
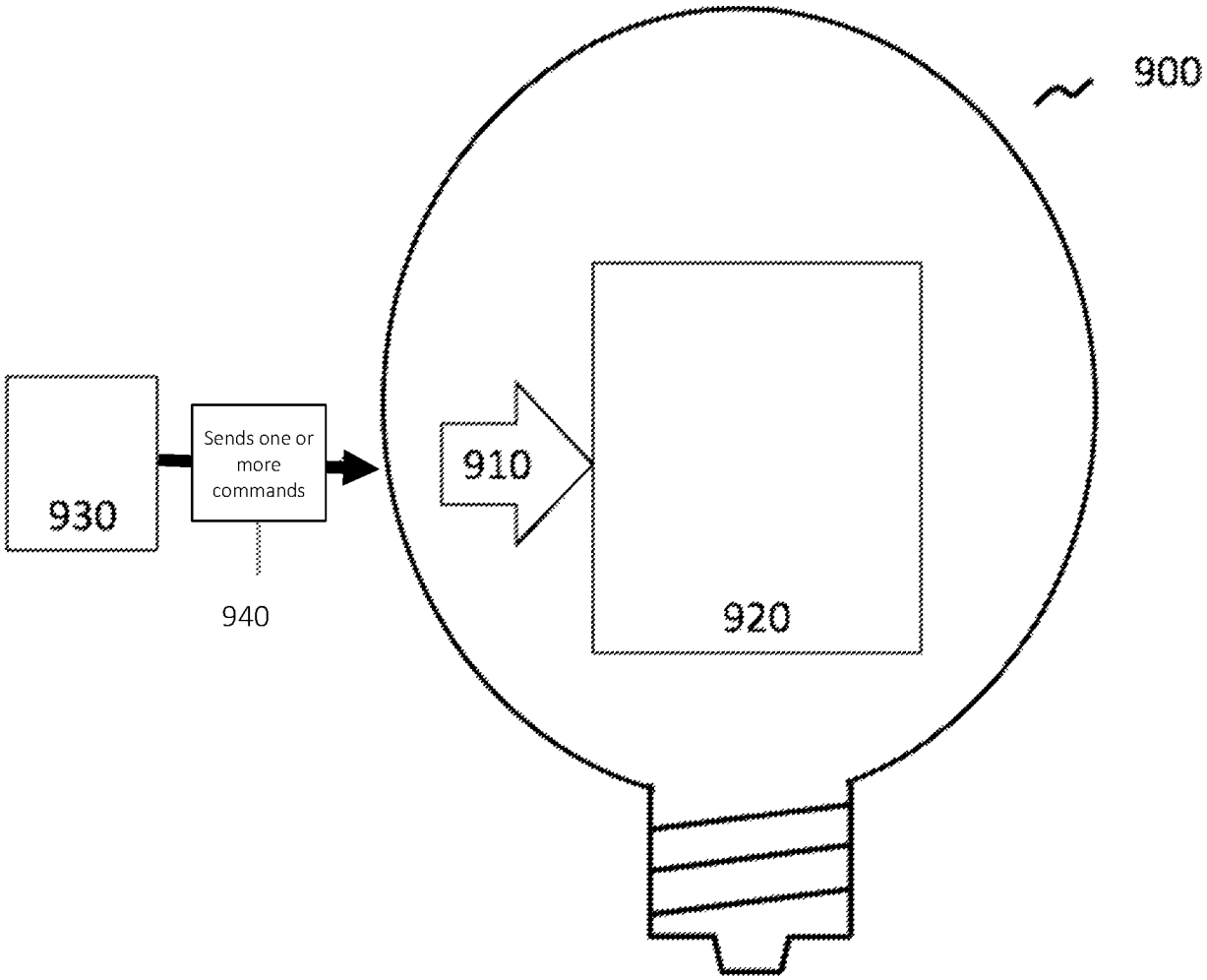
FIG. 9 shows schematically and exemplarily a lighting device.

A lighting device is shown in FIG. 9. In this example the lighting device 900 is a lightbulb, it may however be any type of lighting device such as, but not limited to, an outdoor light pole, a luminaire, a lighting fixture, a LED module or a light strip. The lighting device 900 comprises an input 910 and a controller 920. A further device 930, such as a lighting network controller, hub, bridge, etc. sends one or more commands 940, such as a control command and a switch command.

The input 910 can be a radio frequency input such as a wireless receiver for receiving data over a standardized interface such as Zigbee, Bluetooth, WiFi or any other wireless interface. Instead it may be a wireless interface using any other input, such as a light, e.g. infrared, signal. The input 910 can also be provided using a wired interface. Over the input 910 a switch command and one or more control commands can be received. These can be separate commands or a combined command. For example, the input may receive a switch command, a control command specifying a chromaticity value and a control command specifying an intensity value. As another example, the input may receive a single command comprising all of the switch command and the chromaticity and intensity values. As another example, a single control command may comprise multiple chromaticity values and/or intensity values and/or switch commands. This does not exclude the input from receiving further commands (or: further messages, further packets, further data streams or any other further input).

The controller 920 may be a general-purpose processor, a general-purpose controller or an application-specific controller, for example. The controller 920 is arranged for controlling the lighting device to render a lighting effect. Further, the controller 920 is arranged to switch, based on a switch command received via the input 910, between a first and a second operating mode.

In the first operating mode, the flux at which the lighting effect is rendered is determined based on: the specified chromaticity, the specified intensity value and a maximum (luminous) flux at which the lighting effect can be rendered by the lighting device.

In the second operating mode, the flux at which the lighting effect is rendered is determined based on: the specified chromaticity, the specified intensity value and a predetermined maximum (luminous) flux.

The controller 920 thus controls the lighting device to render the lighting effect based on the specified chromaticity value and intensity value.

Figure 10:
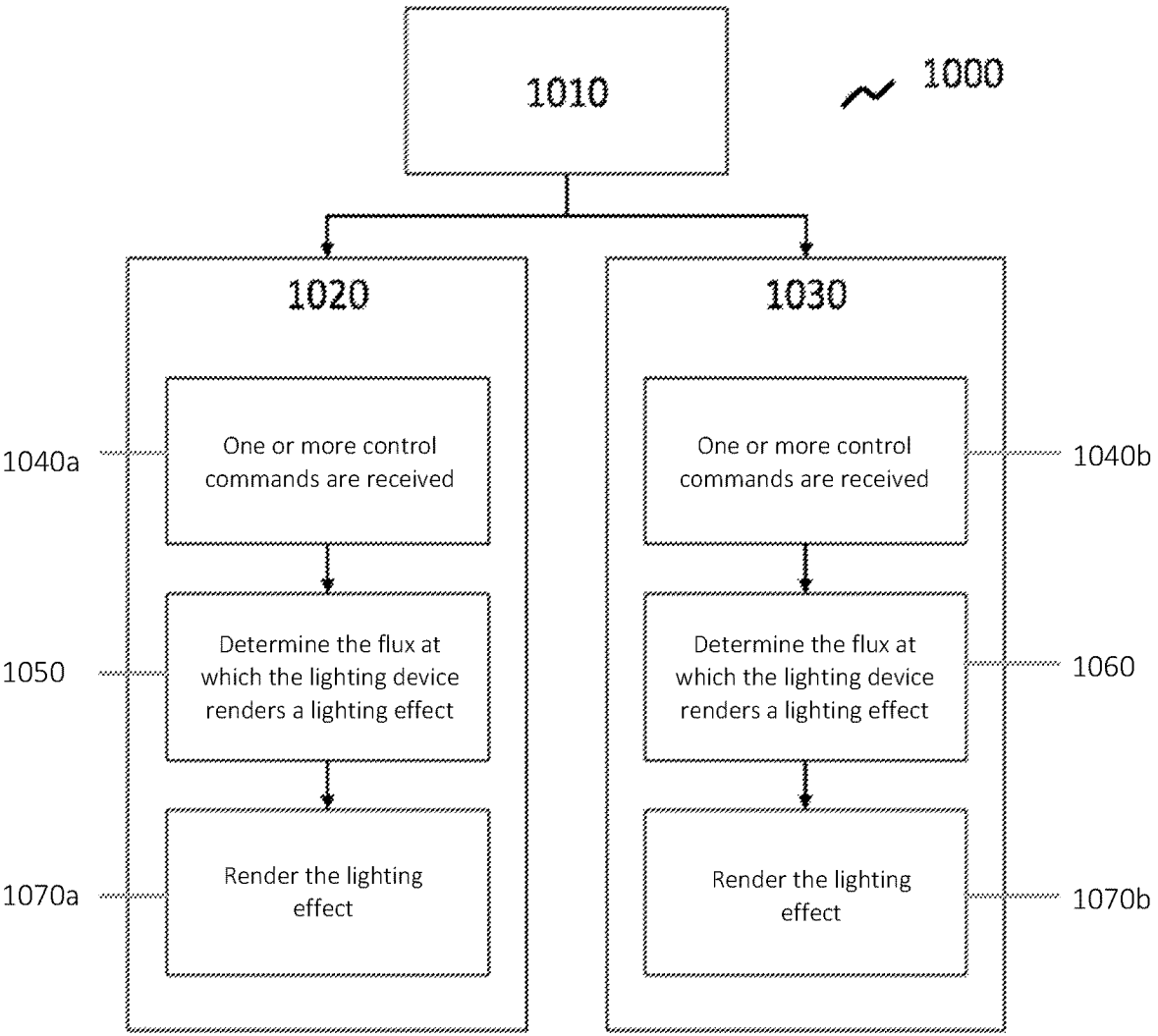
FIG. 10 shows schematically and exemplarily a method of controlling a lighting device.

In FIG. 10 a method 1000 is shown for controlling a lighting device. The method comprises: receiving a switch command 1010 and based on this controlling the lighting device for operating in the first operating mode 1020 or for operating in the second operating mode 1030. In each of the first operating mode and the second operating mode, one or more control commands are received 1040*a*, 1040*b*, the one or more control commands specifying a chromaticity value and an intensity value relative to an intensity value range. The receiving of the switch command 1010 and the receiving of the one or more control commands 1040*a*, 1040*b* may be performed in the same step. In other words, the same command (or: message, packet, data stream or any other input) may comprise both a switch command and a chromaticity value and intensity value.

When operating in the first operating mode 1020, the flux at which the lighting device renders a lighting effect is determined at step 1050 based on: the specified chromaticity, the specified intensity value and a maximum (luminous) flux at which the lighting effect can be rendered by the lighting device.

When operating in the second operating mode 1030, the flux at which the lighting effect is rendered is determined at step 1060 based on: the specified chromaticity, the specified intensity value and a predetermined maximum (luminous) flux. In both the first operating mode and the second operating mode, the method continues at step 1070*a*, 1070*b* in that the lighting device is then controlled to render the lighting effect based on the chromaticity value and the determined flux.

Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality.

A single unit or device may fulfill the functions of several items recited in the claims. The mere fact that certain measures are recited in mutually different dependent claims does not indicate that a combination of these measures cannot be used to advantage.

A computer program may be stored/distributed on a suitable medium, such as an optical storage medium or a solid-state medium, supplied together with or as part of other hardware, but may also be distributed in other forms, such as via the Internet or other wired or wireless teleconnected device systems.

Any reference signs in the claims should not be construed as limiting the scope.

The invention claimed is:

1. A lighting device for rendering a light effect by mixing light output of multiple color channels, wherein the maximum flux at which the lighting device can render the light effect depends on the chromaticity of the light effect, the lighting device comprising:

an input arranged for receiving one or more control commands, the one or more control commands specifying a chromaticity value and an intensity value relative to an intensity value range; and a controller arranged for controlling the lighting device to render a lighting effect based on the chromaticity value and the intensity value;

wherein the controller is further arranged to switch, based on a switch command received via the input, between a first operating mode, in which the flux at which the lighting effect is rendered is determined based on: the specified chromaticity, the specified intensity value and a maximum flux at which the lighting effect can be rendered by the lighting device; and a second operating mode, in which the flux at which the lighting effect is rendered is determined based on: the specified chromaticity, the specified intensity value and a predetermined maximum flux lower than the maximum flux at which the lighting effect can be rendered by the lighting device, wherein the predetermined maximum flux is defined as zero for a channel of the multiple color channels, or wherein the predetermined maximum flux is determined based on maximum flux of one of the multiple channels, or wherein the predetermined maximum flux is determined based on combined maximum flux of a plurality of the multiple channels, and wherein the intensity value range includes one or more exceptional values and/or one or more exceptional value ranges that cause the controller to render the light effect to ignore the predetermined maximum flux and instead render the specified chromaticity at more than the predetermined maximum flux of the lighting device for the specified chromaticity when in the second operating mode.

2. A lighting device according to claim 1, wherein the predetermined maximum flux is zero for a channel for rendering a white color.

3. A lighting device according to claim 1, wherein the predetermined maximum flux is determined based on maximum flux of a channel of the multiple channels having the lowest maximum flux.

4. A lighting device according to claim 1, wherein the predetermined maximum flux is determined based on combined maximum flux of a plurality of primary color channels of the multiple channels.

5. A lighting device according to claim 1, wherein the maximum flux and/or the predetermined maximum flux is further dynamically limited based on operating conditions of the lighting device.

6. A lighting device according to claim 1, wherein the switch command is comprised in the one or more control commands.

7. A method for controlling a lighting device for rendering a light effect by mixing light output of multiple color channels, wherein the maximum flux at which the lighting device can render the light effect depends on the chromaticity of the light effect, the lighting device comprising:

receiving one or more control commands, via an input, the one or more control commands specifying a chromaticity value and an intensity value relative to an intensity value range; and controlling the lighting device, via a controller, to render a lighting effect based on the chromaticity value and the intensity value;

wherein, based on a switch command received via the input, the controlling of the lighting device is performed in a first operating mode, in which the flux at which the lighting effect is rendered is determined based on: the specified chromaticity, the specified intensity value and a maximum flux at which the lighting effect can be rendered by the lighting device; or in a second operating mode, in which the flux at which the lighting effect is rendered is determined based on: the specified chromaticity, the specified intensity value and a predetermined maximum flux lower than the maximum flux at which the lighting effect can be rendered by the lighting device, wherein the predetermined maximum flux is defined as zero for a channel of the multiple color channels, or wherein the predetermined maximum flux is determined based on maximum flux of one of the multiple channels, or wherein the predetermined maximum flux is determined based on combined maximum flux of a plurality of the multiple channels, and wherein the intensity value range includes one or more exceptional values and/or one or more exceptional value ranges that cause the controller to render the light effect to ignore the predetermined maximum flux and instead render the specified chromaticity at more than the predetermined maximum flux of the lighting device for the specified chromaticity when in the second operating mode.

8. A non-transitory computer-readable medium comprising:

at least one software code portion or a computer program product storing at least one software code portion, the software code portion configured to run the method of claim 7 to be performed when run on a computer system.

* * * * *